US009642418B2

(12) United States Patent
Kopcienski

(10) Patent No.: US 9,642,418 B2
(45) Date of Patent: May 9, 2017

(54) SHOE LACE FASTENER AND SYSTEM

(71) Applicant: Jennifer Kopcienski, Bridgewater, NJ (US)

(72) Inventor: Jennifer Kopcienski, Bridgewater, NJ (US)

( * ) Notice: Subject to any disclaimer, the term of this patent is extended or adjusted under 35 U.S.C. 154(b) by 33 days.

(21) Appl. No.: 14/461,523

(22) Filed: Aug. 18, 2014

(65) Prior Publication Data

US 2015/0089780 A1 Apr. 2, 2015

Related U.S. Application Data

(60) Provisional application No. 61/884,313, filed on Sep. 30, 2013.

(51) Int. Cl.

| | |
|---|---|
| ***A43C 7/04*** | (2006.01) |
| ***A43C 7/06*** | (2006.01) |
| ***G09F 21/02*** | (2006.01) |
| ***A43B 3/00*** | (2006.01) |
| ***A43C 11/24*** | (2006.01) |

(52) U.S. Cl.

CPC ..... *A43C 7/04* (2013.01); *A43B 3/0078* (2013.01); *A43C 11/24* (2013.01); *G09F 21/02* (2013.01); *G09F 2021/023* (2013.01); *Y10T 24/3716* (2015.01)

(58) Field of Classification Search

CPC A43C 7/04; A43C 1/00; A43C 11/004; A43C 7/00; A43B 3/0078; A44C 11/24; G09F 21/02; G09F 21/023; Y10T 24/3716

USPC ..... 24/595.1, 593.11, 714.7, 712.1; 36/50.1

See application file for complete search history.

(56) References Cited

U.S. PATENT DOCUMENTS

| | | | | |
|---|---|---|---|---|
| 313,338 A * | 3/1885 | Johnson | A43C 7/04 24/712.6 |
| 497,094 A | 5/1893 | Griffin | |
| 674,494 A * | 5/1901 | Brott | A43C 7/04 24/517 |
| 741,238 A * | 10/1903 | Force | A43C 7/00 24/712.2 |
| 4,258,456 A | 3/1981 | Thurston et al. | |
| 5,042,119 A | 8/1991 | Williams | |
| 5,097,573 A | 3/1992 | Gimeno | |
| 5,109,581 A | 5/1992 | Gould | |
| 5,129,130 A | 7/1992 | Lecouturier | |
| 5,148,614 A | 9/1992 | Kelly | |
| 5,293,669 A | 3/1994 | Sampson | |

(Continued)

FOREIGN PATENT DOCUMENTS

| | | | |
|---|---|---|---|
| DE | 000910871 A * | 5/1954 | A43C 11/004 |
| EP | 1417903 | 5/2004 | |
| GB | 2261013 | 5/1993 | |

*Primary Examiner* — Jack W Lavinder

(74) *Attorney, Agent, or Firm* — Gearhart Law LLC

(57) ABSTRACT

A lace fastener for an article of footwear has at least an upper and a lower half attached by a spring, screw or similar mechanism. The lace fastener has at least one display face that may have the name, color, logo, etc. of the user's choosing. The lace fastener is adhered to the outer portion of the article of footwear, preferably near the top of the article of footwear. Once the article of footwear is laced, the laces are pulled through the lace fastener and the upper half is closed securing the laces in place. The laces may then be pulled through lace holders around the article of footwear in order to hold the laces neatly in place.

7 Claims, 4 Drawing Sheets

(56) References Cited

U.S. PATENT DOCUMENTS

| | | | | |
|---|---|---|---|---|
| 5,335,401 | A | 8/1994 | Hanson | |
| 5,471,769 | A | 12/1995 | Sink | |
| 5,477,593 | A | 12/1995 | Leick | |
| 5,903,959 | A | 5/1999 | Leonardi | |
| 5,924,177 | A | 7/1999 | Jongejan | |
| 5,979,028 | A | 11/1999 | Hicks et al. | |
| 5,996,256 | A | 12/1999 | Zebe | |
| 6,192,559 | B1 | 2/2001 | Munsell | |
| 6,260,246 | B1 | 7/2001 | Lampkins | |
| 6,324,774 | B1 * | 12/2001 | Zebe, Jr. ..... | A43C 3/00 24/712.7 |
| 6,339,867 | B1 | 1/2002 | Azam | |
| 6,679,405 | B2 | 1/2004 | Zalis-Hecker | |
| 6,725,575 | B2 | 4/2004 | Curet | |
| 6,735,829 | B2 | 5/2004 | Hsu | |
| 6,941,683 | B2 | 9/2005 | Freed | |
| 7,287,342 | B2 | 10/2007 | Keen | |
| 7,334,353 | B2 | 2/2008 | Lampkins | |
| 7,398,580 | B1 | 7/2008 | Miller | |
| 7,658,020 | B1 | 2/2010 | Yun | |
| 7,721,468 | B1 | 5/2010 | Johnson | |
| 7,752,774 | B2 | 7/2010 | Usser | |
| 8,332,994 | B2 | 12/2012 | Lin | |
| 8,898,931 | B2 * | 12/2014 | Gerber ..... | A43C 1/04 24/714.7 |
| 2004/0168356 | A1 | 9/2004 | Edlauer | |
| 2013/0117975 | A1 | 5/2013 | Herrera | |

* cited by examiner

SHOE LACE FASTENER AND SYSTEM

CLAIM OF PRIORITY

This application claims the priority of U.S. Ser. No. 61/884,313 filed on Sep. 30, 2013, the contents of which are fully incorporated herein by reference.

FIELD OF THE INVENTION

The field of the invention relates to fasteners/holders, namely lace fasteners/holders for articles of footwear. In particular, to lace fasteners adhered to the outer surface of an article of footwear holding the lace in place and including a decorative design.

BACKGROUND OF THE INVENTION

It is often said that the first thing people notice about others is their shoes. Shoes come in a wide variety of materials, colors, and styles. So much so that they are often conduits into the personality of the wearer, as people often have a message they want to convey when they wear a particular set of footwear.

Shoes generally have a sole, an upper part, a tongue and a lace to tie together the upper part of the shoe. Some shoes, however, have snaps or Velcro® in lieu of a lace. Often, people will modify the way they wear their shoes in order to fit in with a crowd or stand out on their own. One popular style involves wearing one's shoes with the laces remaining untied. These individuals will often tuck the laces down inside the shoe, or tie the lace in a knot in such a way that it leaves one end of the lace separate from the other. This can be uncomfortable because once the lace is tucked in the shoe it often works its way in and around one's foot. Outside of causing general discomfort, the friction created can also lead to blisters and other sores. In other instances, the laces loosen on their own requiring users to repeatedly tighten the laces or risk tripping on them and injuring themselves. Thus, there is the need for a technology that addresses these issues while keeping up with the latest in fashion.

Review of Related Technology

U.S. Pat. No. 8,332,994 teaches a shoelace with a shoelace fastener includes a first retaining base at an end of a first lace and/or a second retaining base at another end of the first lace, and a ratchet and an elastic clipping element are disposed in the first retaining base and the second retaining base respectively, such that the ratchet can be pressed at an end of the elastic clipping element, and the ratchet is pressed by the elastic clipping element into a normal slantingly pressed down status. When use, a fabric shoelace or a serrated plastic groove is passed into the retaining base, and ends of the ratchets are provided for clamping a surface of the fabric shoelace or plastic shoelace to facilitate adjusting the tightness of the shoelace.

U.S. Pat. No. 7,658,020 teaches an eyestay ornament for a laced shoe provides a subtle but impressive way to add an aesthetic accent to the appearance of the shoe. A central marquee with multiple display faces is rotatably mounted to a pin captured in collars integrated to buckles on each end of the central marquee. The buckles are sized and designed to receive a shoe lace woven therethrough to install the ornament on the instep area. Rotating the central marquee provides a quick and easy way to change the appearance of the ornament.

U.S. Pat. No. 6,192,559 teaches a shoelace locking apparatus. The apparatus comprises a body attachable to a first end of a shoelace and a cup. The body defines a laterally opening locking passage therein for receiving a second end of the shoelace. The cup may be integral with the body or with a separate extension component. By tying a knot in a desired location in the second end of the shoelace and stretching the lace, the second end of the lace may be moved into an engaged position in which tension in the stretched lace tends to maintain the knot in the cup. The apparatus may also comprise a lock attachable to the second end of the shoelace such that the lock is also positioned in the cup and rotatable to a locking position preventing undesired longitudinal movement of the lock and shoelace.

Various devices are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE INVENTION

A lace fastener for an article of footwear, the lace fastener having an upper half and a lower half, the upper and the lower half being substantially rectangular in shape and hingedly connected at one end, wherein the upper half has a lace gripping protrusion and the lower half is adhered to the article of footwear; and at least one display face disposed on an upper surface of the upper half.

The lace fastener is adhered to the article of footwear in question. The lace fastener can be adhered in a number of ways including chemically and mechanically. The upper half of the lace fastener is lifted and the lace is pulled from the eyelet of the article of footwear between the two halves (upper and lower). When the desired tension has been reached, the upper half is closed to lay substantially parallel to the lower half. There are a number of blunt teeth along an edge of the upper half and these lace gripping protrusions help to secure the lace in place and prevent it from loosening. The free ends of the lace are then secured in lace holders disposed along an outer surface of the article of footwear. These lace holders are loops that have elastic properties. The lace, once pulled through the lace holder, will remain secure and out of the way of the user's foot. This creates a unique style as well as aiding in user safety. Additionally, the lace fastener may have a number of display faces. The inclusion of multiple faces can create more complex patterns or three-dimensional shapes. The lace fastener may have a number of different images or one continuous image.

In an alternate embodiment of the present invention there is lace fastener for an article of footwear having an upper half and a lower half hingedly connected and having a lace gripping protrusion; and at least one display face disposed on an upper surface of the upper half. The lace is secured in place by blunt teeth or a bar. The lace fastener itself can be a number of shapes including polygons, logos, and customized designs.

In another aspect of the invention, there is a system for securing a lace of an article of footwear having a lace fastener with an upper half and a lower half hingedly connected and having a lace gripping protrusion with the lower half being adhered to an outer surface of an article of footwear and the upper half having a display face disposed on an upper surface; and a plurality of lace holders disposed on an outer surface of an article of footwear.

The lace fasteners are to be the lace fasteners described above. The article of footwear further has a plurality of lace holders disposed on an outer surface of the article of footwear. Preferably there are two or three lace holders, however, the number of lace holders can range from one to fifteen depending on the article of footwear and the particular style of the lace holders. The lace holders are bands with elastic properties that are adhered on opposing ends to the outer surface of the article of footwear. This forms an elastic loop and provides a place for the excess lace to be stored. Once the lace is pulled through the lace fastener and secured, the loose ends of the lace can be secured. The lace holders may permit the lace to be secured in a variety of fashions and patterns creating a unique look for the user.

In general, the present invention succeeds in conferring the following, and others not mentioned, benefits and objectives.

It is an object of the present invention to provide a lace fastener that removes the need for an individual to tie their shoes.

It is an object of the present invention to provide a lace fastener that secures a lace in place.

It is an object of the present invention to provide holders for any excess lace once the lace is secured in place.

It is an object of the present invention to provide a fashion piece for an article of footwear.

It is an object of the present invention to provide a simple, yet effective way of securing laces.

It is yet another object of the present invention to provide a colored outer surface that has various designs, colors, logos, and the like.

DETAILED DESCRIPTION OF THE INVENTION

Figure 1:
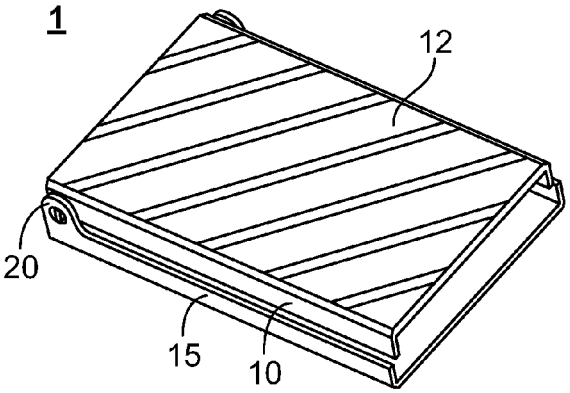
FIG. 1 is a perspective, closed view of a preferred embodiment of the present invention.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to FIG. 1, there is a lace fastener 1 preferably for an article of footwear 5. The lace fastener 1 has an upper half 10 and a lower half 15. The upper half 10 and lower half 15 may be composed of a suitable hard and scratch resistant material. Such a material may comprise metals including but not limited to steel, iron, aluminum, copper, titanium, and alloys such as brass and bronze or any combination thereof. Further, the material may comprise plastics including but not limited to polyethylene terephthalate, high-density polyethylene, polyvinyl chloride, polyvinylidene chloride, polystyrene, high impact polystyrene and polycarbonate, or any combination thereof. It may be advantageous to have the lace fastener 1 formed from a combination of different types of materials such as metals, plastics, rubbers, composites, and the like or any combination thereof.

It may be preferential to include a scratch resistant coating to further protect the materials if not inherent in the material used. Any additional protection measures should be clear as to not obscure the display face 12 or design of the lace fastener 1. These two halves are connected by a hinge 20. The hinge 20 may be a spring, screw, or other acceptable coupling mechanism. Preferably, the hinge 20 is fashioned in such a way that it provides a gap between the upper half 10 and the lower half 15 that is of a size to permit passage of a lace 40 therethrough.

The lace fastener 1 also has at least one display face 12. This display face 12 can bear the image or design of the user's choice. Alternatively, there may be pre-set display faces 12 that come with the purchase of particular footwear (i.e. a Nike® swoosh on a Nike® shoe). Even yet, the display faces 12 may be interchangeable. In such an instance, magnets would preferably be used although various removable coupling mechanisms may be employed. This would allow an individual user to customize their look throughout the day or according to the clothing they are wearing.

The display face 12 itself may comprise a number of materials. A lace fastener 1 could have a display face 12 made with small beads set into a particular pattern and coated with a resin or epoxy. The display face 12 could have a painted surface. Even yet, the display face 12 could have a pattern or logo that is made of enamel. There is any number of other suitable options not named herein that would be practical for such a use. The number of display faces 12 may vary as well. Ideally, there is just one display face 12. However, it may be preferential to have a pyramid design with multiple display faces 12 wherein each face has a different image or a singular image spanning all the display faces 12. Again, any number of display faces 12 may be used to create a specific look.

Figure 2A:
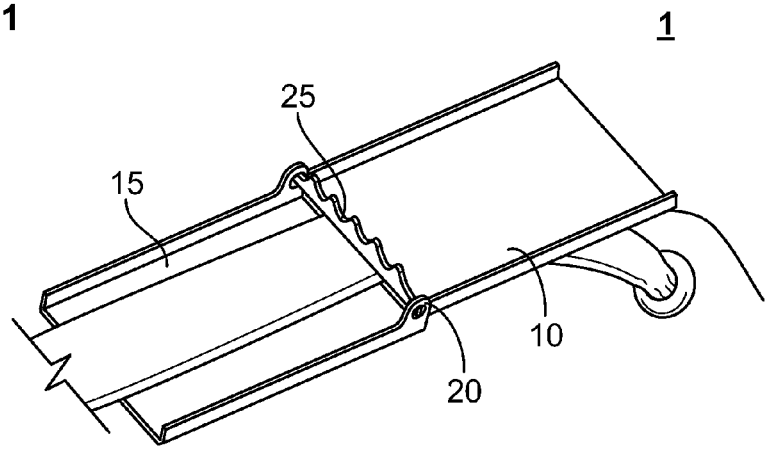
FIG. 2A is a perspective, open view of a preferred embodiment of the present invention.
Figure 2B:
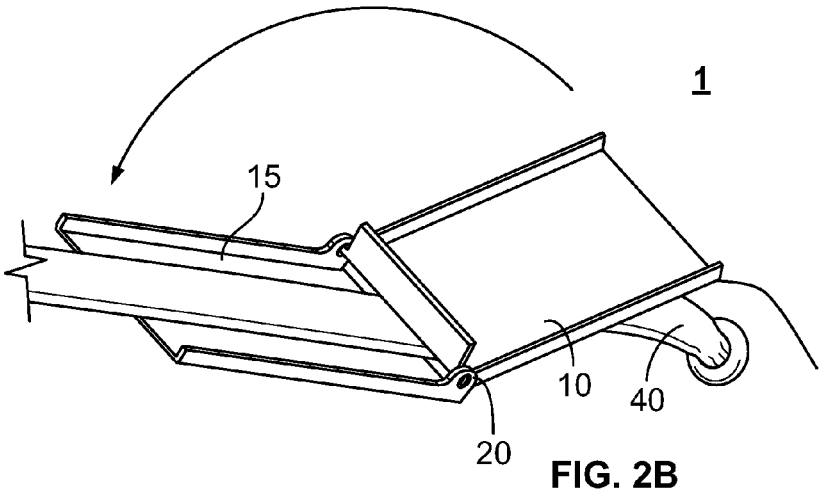
FIG. 2B is a perspective, open view of an alternate embodiment of the present invention.

FIGS. 2A and 2B show a lace fastener 1 that is in an open position displaying the internal structure of the lace fastener 1. In FIG. 2A, there is a lace fastener 1 with a lace gripping protrusion 25. The lace gripping protrusion 25 may take a number of forms that are designed to hold and secure without damaging the lace 40. Here, the lace gripping protrusion 25 is a series of blunt teeth designed to secure the lace 40 in place. When the upper half 10 is closed (see FIG. 1) the lace gripping protrusion 25 rotates and clamps down on the lace 40. Ideally, the lace gripping protrusion 25 will be able to hold a lace 40 throughout the day. Thus, the lace gripping protrusion 25 should be able to experience about 0.25 kg (0.55 lbs) to about 4.5 kg (10 lbs) and preferably a range of 2.0 kg (4.4 lbs) to 3 kg (6.6 lbs) of pull without failing. This means that the lace 40 will not pull laterally through the lace fastener 1 or that the upper half 10 of the lace fastener 1 will not open under these conditions.

It may be necessary to use a clip (not shown) or similarly structured locking mechanism to further secure the lace fastener 1. Such a clip would likely be attached by a hinge to the lower half 15 while not interfering with the practical functionality of the lace fastener 1. Alternatively, the clip may be permanently adhered to the upper half 10. The clip should be fashioned from the same material as the lace fastener as a whole, however, it may be practical to use a different material for aesthetic or styling purposes. The clip or similarly suited locking structures may be present in any embodiment of the lace fastener. The purpose of such a mechanism is to further prevent the upper half 10 of the lace fastener 1 from undesirably moving from a closed position. FIG. 2B shows an alternate embodiment of a lace fastener 1. Here, the lace gripping protrusion 25 is bar and operates substantially the same as previously described.

Figure 3:
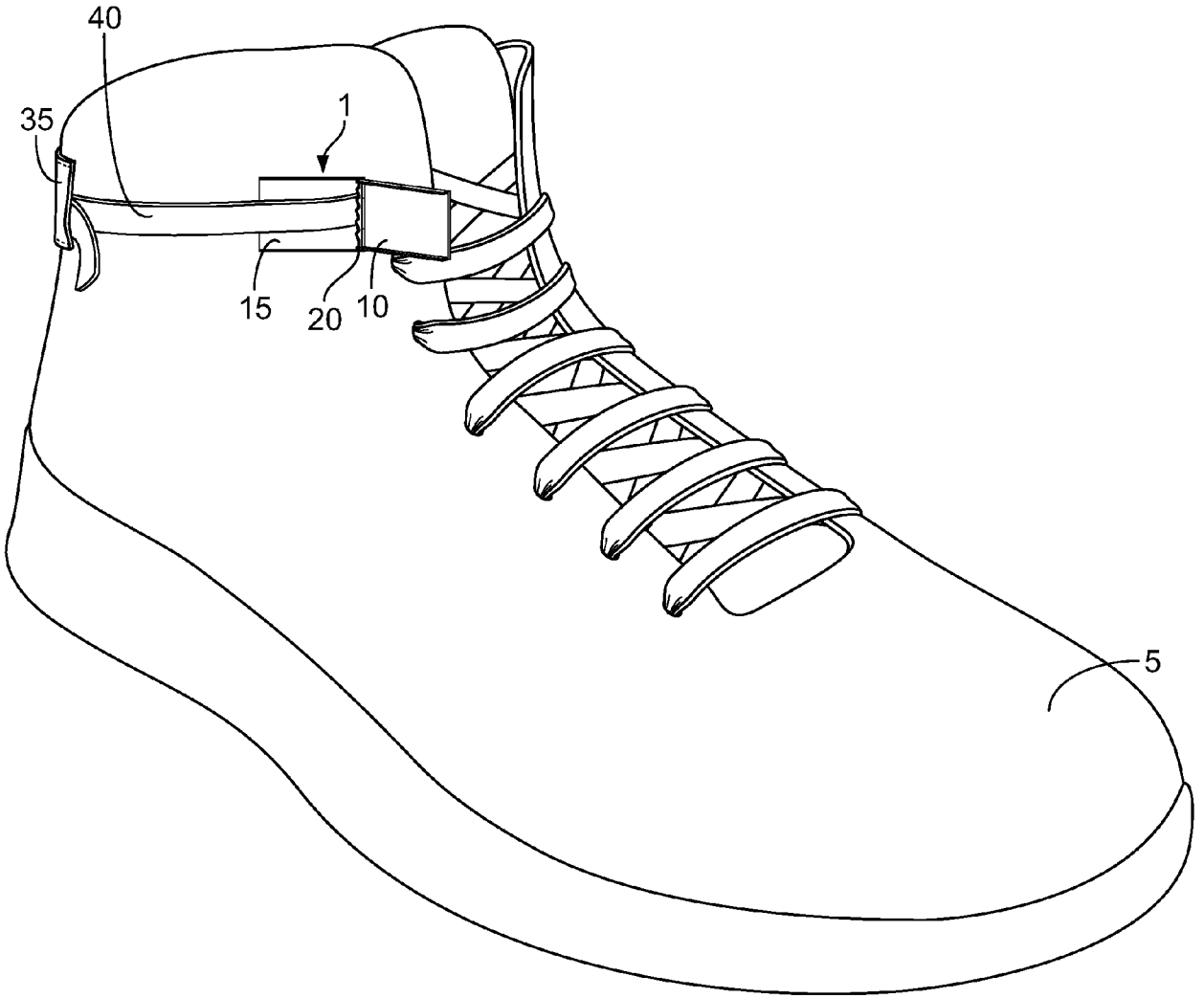
FIG. 3 is a perspective view of an article of footwear employing the present invention.
Figure 4:
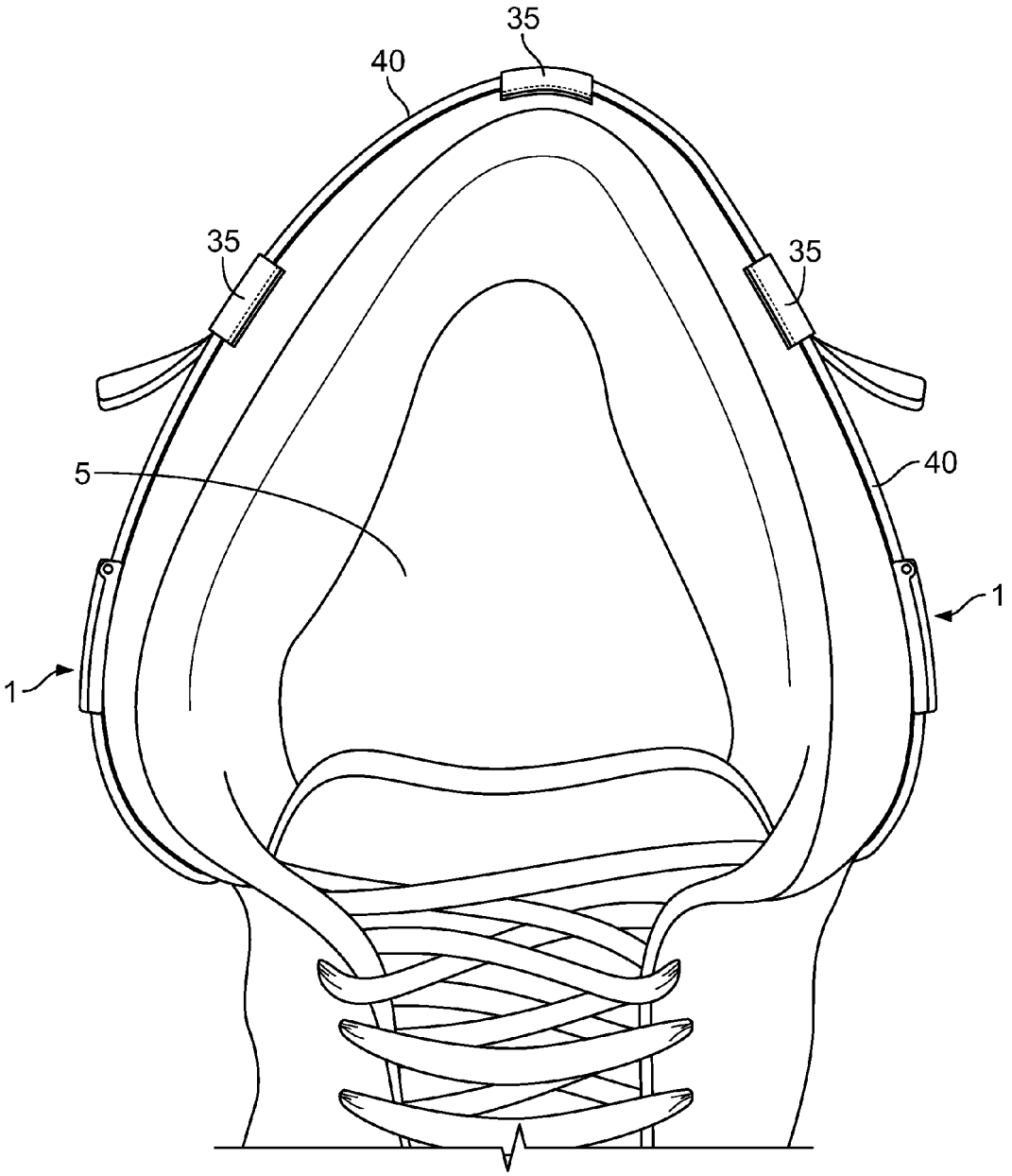
FIG. 4 is a top view of an article of footwear employing the present invention.
Figure 5:
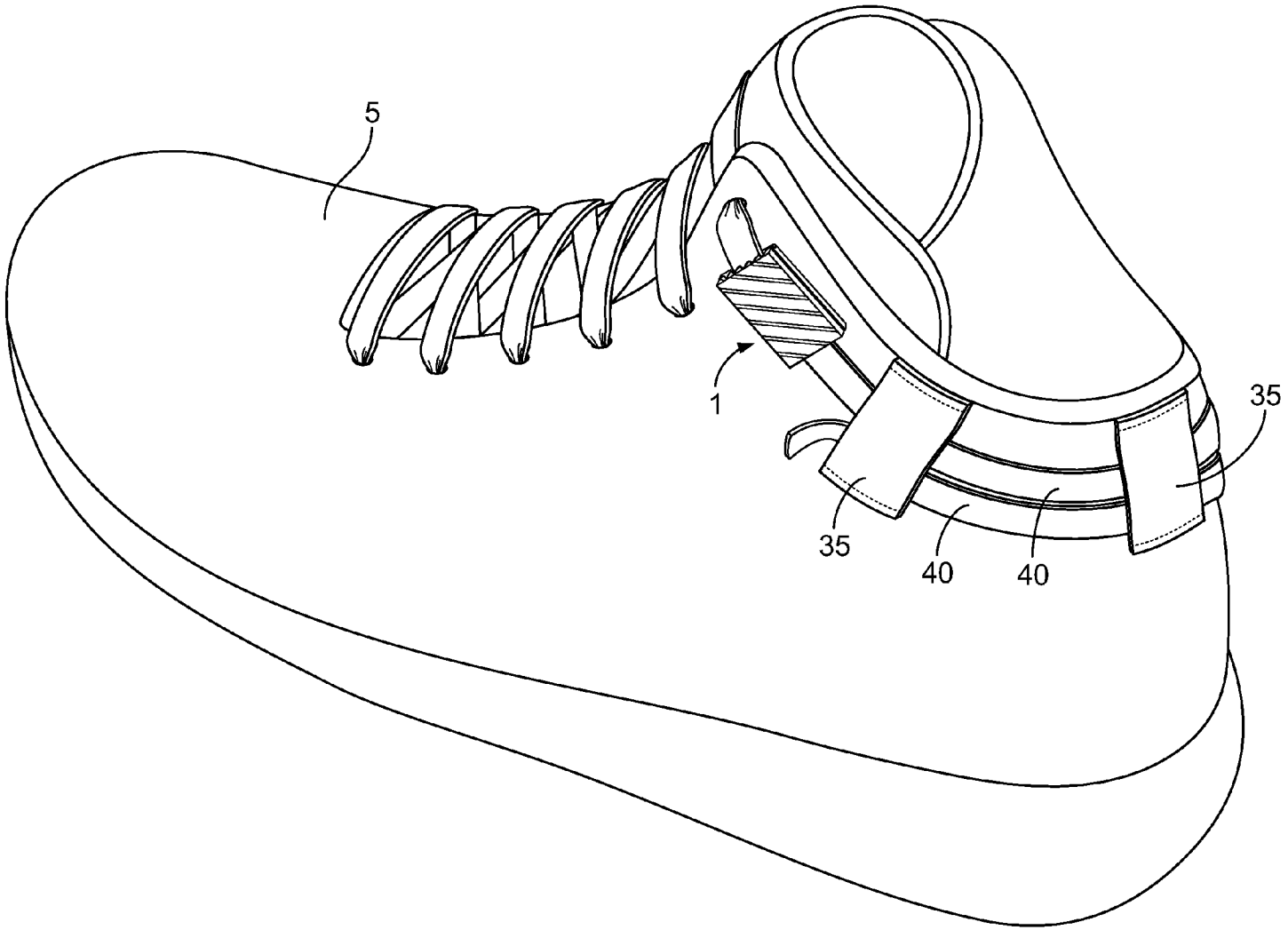
FIG. 5 is a perspective view of an article of footwear employing the present invention and showing the lace holders.

FIGS. 3-5 illustrate the lace fastener 1 adhered to an article of footwear 5 as intended. In FIG. 3, the lace fastener 1 is seen adhered to the outer surface of an article of footwear 5. These adherence means can vary but include adherence by mechanical adherence or by adhesives. If mechanical adherence (i.e. stitching) is to be employed, the lower half 15 would need to provide for such an adherence. Thus, having conduits (not shown) for the stitching to pass through and thereby adhering the lace fastener 1 to the article of footwear 5 would be desired. The lace fastener 1 may also be attached with a number of rivets. Alternatively, chemical adherences may be employed. In this instance, the use of an epoxy or glue may be suitable. It would be appreciated by those in the art that adherence means are well known and that any number of these means may be used interchangeably depending on the particular surface the lace fastener 1 is being adhered.

Once a user laces up the article of footwear 5, they can thread the lace 40 through the lace fastener 1. The upper half 10 is closed by the user. This is achieved by flipping the upper half 10 to expose the display face 12 and depressing the upper half 10 until the lace 40 is secured. This is best shown in FIG. 4, which supplies a top view demonstrating a full 360° view around the top of the article of footwear 5. The lace 40 has been pulled taunt through the lace fasteners 1, with each fastener 1 being located in substantially the same place on either side of the article of footwear 5. The lace 40 is held between the upper half 10 and the lower half 15 by the lace gripping protrusion 25 and secured in place. Excess lace 40 can be wrapped around the article of footwear 5 and secured by the lace holders 35. These lace holders 35 provide a place for the excess lace 40 to be placed without creating discomfort or an untidy appearance. The lace holders 35 are elastic and attached at two points to the article of footwear 5 forming a loop. The lace 40 is passed between these points of adherence and held securely in place.

In general, the size and shape of the upper half 10 and the lower half 15 can vary greatly as can the display faces 12. Generally, any size lace fastener 1 can be used as long it as does not interfere with the wearing of the article of footwear 5. Some articles of footwear 5 such as boots may have substantially larger lace fasteners 1 than, for example, a tennis shoe. The upper half 10 and lower half 15 of the lace fastener 1 can be the same shape. The upper half 10 and lower half 15 can also be different in shape from one another. The difference in shape may be used to create a more complete image. For example, the upper half 10 may be shaped as a sun with rays extending therefrom. The lower half 15 may have rays that extend between the rays of the upper half 10. The same idea could hold true for a flower shaped structure with each half 10, 15 supplying interspersed petals. Additionally, the position of the lace fastener 1 may differ. It may be desirable to have them located in different orientations to create a unique design for the article of footwear 5. The same holds true for the lace holders 35. The lace holders 35 may be configured as shown in FIGS. 3-5. The lace holders 35 may also create a variety of patterns including zigzags, waves, polygons, and the like. The number of lace holders 35 may vary depending on the particular needs of a pattern of a specific article of footwear 5.

What is claimed is:

1. A system for securing a lace of an article of footwear comprising:

a first and a second lace fastener, with each of the first and the second lace fastener having an upper half and a lower half hingedly connected to one another at a first end, wherein the first and the second lace fasteners each have a lace gripping protrusion, the lace gripping protrusion being disposed at the first end and including a plurality of teeth oriented in series in a direction perpendicular to a length of the lace, and wherein the lower half of the first and the second lace fasteners are adhered to an outer surface of an upper of the article of footwear and each of the upper halves has a display face disposed on an upper surface thereon; and at least one elastic lace holder disposed on the outer surface of the upper of the article of footwear, wherein the at least one elastic lace holder is coupled to the outer surface of the upper of the article of footwear at a first point and a second point forming an elastic loop, the first point and the second point being positioned such that an opening in the elastic loop is approximately parallel to a sole of the article of footwear; and wherein at least one of the at least one elastic lace holder is positioned on a rear portion of the shoe; and wherein the first lace fastener is positioned on a first side of a tongue on the outer surface of the upper of the article of footwear and the second lace fastener is positioned on a second side of the tongue on the outer surface of the upper of the article of footwear.

2. The system of claim 1 wherein the first and the second lace fasteners are configured to open in a direction away from where the lace is coupled to the article of footwear.

3. The system of claim 1 wherein the at least one elastic lace holder disposed around a periphery of the article of footwear.

4. The system of claim 1 wherein the at least one elastic lace holder is disposed around the collar of the article of footwear.

5. The system of claim 1 wherein the lace is pulled through and secured by the elastic loop formed by the at least one elastic lace holder.

6. The system of claim 1 wherein there are a plurality of elastic lace holders.

7. The system of claim 6 wherein the plurality of elastic lace holders form a pattern on the outer surface of the upper of the article of footwear.

* * * * *